United States Patent [19]

Taglarino

[11] 4,218,786

[45] Aug. 26, 1980

[54] WATER SAVING TRAP PRIMER

[76] Inventor: Joseph Taglarino, 107 S. Lincoln Ave., Tampa, Fla. 33609

[21] Appl. No.: 10,373

[22] Filed: Feb. 8, 1979

[51] Int. Cl.[3] ..... E03C 1/24

[52] U.S. Cl. ..... 4/206; 4/DIG. 9; 4/207; 4/191; 4/415; 4/661; 4/653

[58] Field of Search ..... 4/207, 1, 422, 256, 4/208, 203, 191, 197, 210, 209 R, 218, 197, DIG. 9, 415

[56] References Cited

U.S. PATENT DOCUMENTS

| | | | |
|---|---|---|---|
| 292,055 | 1/1884 | Riker | 4/207 |
| 796,848 | 8/1905 | Leanhart | 4/422 |
| 3,526,547 | 9/1970 | Shock | 4/256 X |
| 3,766,575 | 10/1973 | Grangs | 4/207 X |

FOREIGN PATENT DOCUMENTS

| | | | |
|---|---|---|---|
| 397066 | 8/1933 | United Kingdom | 4/424 |
| 485689 | 5/1938 | United Kingdom | 4/424 |

*Primary Examiner*—Henry K. Artis
*Attorney, Agent, or Firm*—Stein & Frijouf

[57] ABSTRACT

A primer is disclosed for installation in a floor drain water trap located in a lower position relative to a sink drain and sink water trap. A first fitting is disposed upstream of the floor drain water trap. A second fitting is disposed in the sink drain upstream of the sink water trap. A conduit interconnects the first and second fittings to direct waste water from the sink drain to the floor drain water trap thereby maintaining the water level therein to insure a proper seal in the floor drain water trap. The foregoing abstract is merely a resume of one general application, is not a complete discussion of all principles of operation or applications, and is not to be construed as a limitation on the scope of the claimed subject matter.

8 Claims, 4 Drawing Figures

WATER SAVING TRAP PRIMER

BACKGROUND OF THE INVENTION

1. Field of the Invention

This invention relates to traps and more particularly for trap primers for maintaining the water level in a trap to insure a proper seal therein.

2. Description of the Prior Art

Various types of inputs and configurations have been devised in the prior art for overcoming various problems encountered in the water trap art. U.S. Pat. No. 332,911 shows an overflow trap for a washbasin, bathtub and the like. U.S. Pat. No. 796,846 shows an S-shaped water closet trap having an auxiliary siphon tube connecting the plural traps. U.S. Pat. No. 3,526,547 illustrates a method and apparatus for cleaning a drain trap having an auxiliary input to the drain trap. U.S. Pat. No. 3,766,575 discusses a vented drain for recreational vehicles and the like. The aforementioned patents have solved many of the problems and have made substantial improvements in the water trap art.

One particular area of concern is a trap primer for a floor drain disposed in proximity to a second water trap such as a sink or the like. In most commercial lavatories a central floor drain is required by State Code to have a trap primer to maintain the water level within the floor drain trap. Since the floor drain is subject to evaporation, the water level within the floor drain trap must be maintained in order to insure a proper seal in the floor drain trap. To meet the requirements of State Codes, a water line is generally connected to the floor drain trap to maintain the water level therein. Unfortunately, these prior art trap primers utilized clean water, thereby producing a serious energy and ecological waste. In addition, the floor drain primers available to the prior art incorporated a movable check valve within a housing for providing a limited flow of clean water to the trap during use of a nearby sink. Accordingly, each time the sink is used in a commercial lavatory, a small portion of the incoming water is directed by a trap primer to the floor drain trap. The trap primer valves of the prior art are generally expensive and are subject to malfunction.

Therefore it is an object of this invention to provide an apparatus which overcomes the aforementioned inadequacies of the prior art devices and provides an improvement which is a significant contribution to the advancement of the trap primer art.

Another object of this invention is to provide a primer for a first water trap located below a drain wherein waste water from the drain is directed to the first water trap for maintaining the water level therein.

Another object of this invention is to provide a primer for a first water trap located below a drain which utilizes waste water as a primer for the first water trap thereby providing an energy and ecological savings of water.

Another object of this invention is to provide a primer for a first water trap located below a drain which is adaptable to traps already constructed and adaptable to fixtures presently under construction.

Another object of this invention is to provide a primer for a first water trap located below a drain which meets State Code Standards while reducing the cost of materials and labor for installation.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with the specific embodiment shown in the attached drawings and explained in the detailed discussion. For the purpose of summarizing the invention, the invention may be incorporated into a primer for a first water trap located below a drain having a second water trap. A first fitting is disposed upstream of the first water trap. Whereas a second fitting is disposed in the drain upstream of the second water trap. A conduit interconnects the first and second fittings enabling waste water from the drain to be diverted by the conduit to the first water trap for maintaining the water level in the first water trap to insure a proper seal therein.

In a more specific example of the invention, the first water trap may be a floor drain water trap located in proximity the second water trap which is preferably a sink water trap mounted in an elevated position relative to the floor drain water trap. The first and second fittings are disposed above the water levels of the respective first and second traps. In a specific embodiment of the invention, the second fitting comprises a collar engagable between the sink drain tube and the sink trap. An aperture is disposed on an external surface of the collar for communicating with the conduit. In still another embodiment of the invention, the second fitting comprises an aperture in a sidewall of a sink drain for communicating with the conduit. In still another embodiment of the invention, the second fitting comprises an aperture in a sidewall of the sink trap for communicating with the conduit means. This embodiment is commonly referred to as a P-trap with the aperture located above the water line of the trap.

The apertures in the trap preferably comprise threaded apertures for connection to the conduit means. The apertures in the first and second fittings preferably include plural apertures each having a plug enabling the installer to select an appropriate orientation for proper installation. Conventional traps, collars, or drain tubes may incorporate plugged apertures enabling the installer to utilize these conventional parts for the trap primer by merely removing the plugged aperture. A fitting on the conduit is threadably engageable with the apertures of the first and second fittings resulting in a simple and inexpensive system.

It should be appreciated that the foregoing arrangement of elements utilizes the waste water of a sink or elevated trap to prime or maintain the level of a lower water trap. This arrangement provides a substantial savings of water over the prior art trap primers utilizing fresh water diverted from an incoming water line.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifing or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 1:
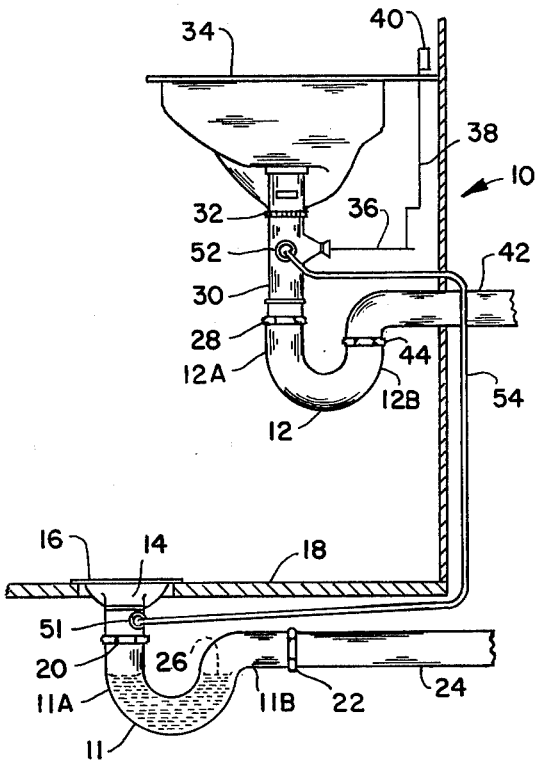
FIG. 1 is a side view partially in section of a primer for a floor drain water trap located in proximity to a sink drain and water trap.

Similar reference characters refer to similar parts throughout the several views of the drawings. For a more clearer understanding of the invention, the following number identifications taken in connection with the detailed description and the drawings set forth the preferred mode or practice of the invention:

| | | | |
|---|---|---|---|
| 10 | primer | 40 | handle |
| 11 | first water trap | 42 | drain pipe |
| 11A | upstream end | 44 | coupling |
| 11B | downstream end | 51 | first fitting |
| 12 | second water trap | 52 | second fitting |
| 12' | second water trap | 54 | conduit |
| 12A | upstream end | 56 | collar |
| 12B | downstream end | 58 | connector |
| 14 | floor drain | 60 | connector |
| 16 | mesh input | 62 | threaded aperture |
| 18 | floor | 64 | plug |
| 20 | coupling | 72 | apertures |
| 22 | coupling | 74 | plugs |
| 24 | drain pipe | 78 | connector |
| 26 | water level | 80 | connector |
| 28 | coupling | 82 | drain fitting |
| 30 | drain fitting | 84 | drain pipe |
| 32 | fastener | 86 | wall |
| 34 | sink | 88 | threaded bore |
| 36 | drain control lever | 90 | compression fitting |
| 38 | arm | 94 | compression cap |

DETAILED DESCRIPTION

FIG. 1 illustrates a primer shown generally as 10 for a first water trap 11 located below a sink drain having a second water trap 12. The first water trap 11 is connected to a floor drain 14 having a screen or mesh input 16 disposed in a floor 18, shown in section. The floor drain 14 is connected through a coupling 20 to the upstream end 11A of the first water trap 11. The downstream end 11B of the first water trap 11 is connected through a coupling 22 to a drain pipe 24. The water level 26 shown is required within the first water trap 11 to maintain a gas seal between the drain pipe 24 and the mesh input 16. Evaporation of the water within the first trap 11 through mesh input 16 has caused many states to enact plumbing codes requiring a trap primer or other means for a floor drain trap to maintain the water level within the trap thus insuring a gas seal therein.

The second water trap 12 has an upstream end 12A connected by a coupling 28 to a drain fitting 30 secured by a fastener 32 to a sink 34. A drain control lever 36 is connected to an arm 38 terminating in a handle 40 for controlling the position of the drain plug (not shown). The downstream end 12B of trap 12 communicates with drain pipe 42 by coupling 44.

The invention comprises a first fitting 51 disposed at the drain 14 in proximity to the upstream end 11A of the first water trap 11. A second fitting 52 is disposed at the upstream end 12A of the second water trap 12. The first and second fittings 51 and 52 are preferably disposed above the water levels of the first and second traps, respectively. A conduit 54 interconnects the first and second fittings 51 and 52. The primer 10 comprising the first and second fittings 51 and 52 and the conduit 54 diverts a portion of the waste water entering from sink 34 to the first water trap 11 for maintaining the water level 26 in the first trap 11 to insure a proper seal therein. It should be emphasized that the water used to prime the floor drain trap 11 is waste water discharged from sink 34 prior to entering the second trap 12. In the prior art trap primers, clean water was used to prime the floor drain 11. The present invention utilizes waste water to prime the floor drain 11 resulting in substantial saving of water and energy.

Figure 2:
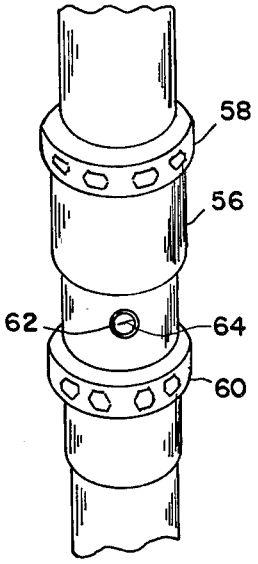
FIG. 2 is a detailed view of the fitting compatible for use with the sink drain shown in FIG. 1.

FIG. 2 is a variation of the invention shown in FIG. 1 illustrating a collar 56 which is suitable for mounting between a conventional drain fitting 30 and a conventional sink water trap as shown in FIG. 1. Connectors 58 and 60 respectively secure the collar 56 between the drain fitting 30 and the sink trap 12. The collar 56 includes an aperture 62 shown as a threaded hole for receiving a plug 64. The collar 56 is rotatable relative to drain 30 enabling the conduit 54 to be moved to different orientations.

Figure 3:
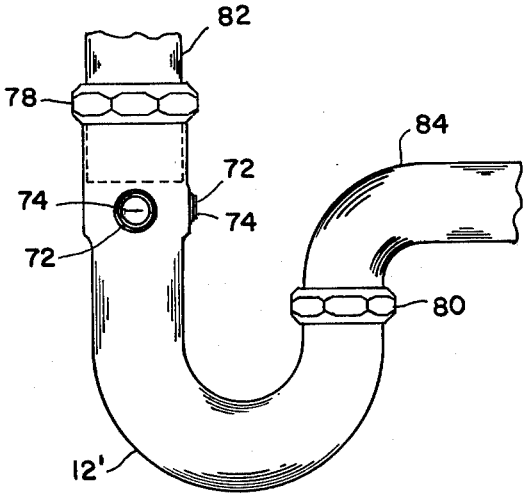
FIG. 3 is a second embodiment of a fitting compatible for use with the sink drain in FIG. 1.

FIG. 3 shows a variation of the inventions shown in FIG. 2 wherein a second trap 12' commonly referred to as a P-trap includes a plurality of integral threaded apertures 72, each having a plug 74. Connectors 78 and 80 respectively connect the trap 12' to a drain fitting 82 and a drain pipe 84. The inclusion of plug apertures 72 in a conventional P-trap enables an installer to use the P-trap in a conventional manner or to remove a plug 74 to utilize the invention described herein.

Figure 4:
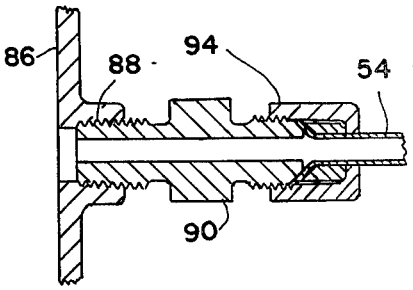
FIG. 4 is a third embodiment of a fitting compatible for use with the sink drain shown in FIG. 1.

FIG. 4 illustrates a sectional view of one example for connecting the conduit 54 to the first and second fittings 51 and 52. The pipe or trap wall 86 comprises a threaded boss 88 for receiving a plug (not shown). Removal of the plug enables a compression fitting 90 to be threadably inserted therein. A flared end of conduit 54 is secured to compression fitting 90 by a cap 94. Although this is a preferred simple method of securing the conduit 54 to either the first or second fittings 51 and 52, it should be understood that various other means or apparati may be incorporated to secure the conduit 54 to the first and second fittings 51 and 52.

The foregoing specification has disclosed a simple, reliable and inexpensive apparatus for priming a floor drain water trap. Although the invention has been described in terms of a sink and a floor drain water trap, it should be understood that the invention is not limited thereby. The low material cost and installation cost of this invention should be readily appreciated. In addition, existing traps, collars and drain tubes may be modified in a very simple and efficient manner to utilize the teaching of this invention. Various types of coupling devices and elements may be included to interconnect the conduit between the first and second fittings of the first and second water traps. The invention finds greatest utility in commercial installations. In a domestic installation, hair or other foreign material could block conduit 54. However this problem is not present in commercial lavatories.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

The invention claimed is:

1. A primer for a first water trap located below a drain receiving waste water, comprising in combination:

a first fitting connected to the first water trap;

a second fitting connected to the drain; and conduit means interconnecting said first and second fitting enabling the waste water received by the drain to be diverted by said conduit means to said first water trap for maintaining a constant water level in the first trap to insure a proper seal therein upon use of the drain.

2. A primer as set forth in claim 1, wherein said first fitting is disposed above the normal water level of the first trap; and said second fitting is disposed above the normal water level of a second trap enabling the waste water from the drain to enter said conduit means upon the elevation of the liquid level in the second trap.

3. A primer as set forth in claim 1, wherein said second fitting comprises a collar engageable between a sink drain tube and a sink trap; and an aperture disposed on a surface of said collar for communicating with said conduit means.

4. A primer as set forth in claim 1, wherein said second fitting comprises an aperture in a side wall of a second trap for communicating with said conduit means.

5. A primer as set forth in claim 1, wherein said first fitting comprises an aperture in a side wall of the first trap for communicating with said conduit means.

6. A primer as set forth in claim 1, wherein said first and second fitting comprises threaded apertures for connection with said conduit means.

7. A primer for a floor drain water trap located in proximity to a sink water trap mounted in an elevated position relative to the floor drain water trap;

a first fitting disposed in the upstream end of the floor drain water trap;

a second fitting disposed in the upstream end of the sink water trap; and conduit means interconnecting said first and second fittings for directing waste water from the sink to the floor drain water trap for maintaining a constant water level therein to insure a proper trap seal in the floor drain water trap upon use of the sink.

8. A primer for a floor drain water trap located below a sink drain and water trap, comprising in combination:

a first fitting disposed in the floor of said drain water trap for providing liquid communication to the upstream side of the floor drain water trap;

a second fitting disposed in the sink drain for providing liquid communication to the upstream side of the sink water trap;

one of said fittings comprising a boss on the side wall of a P trap located above the normal liquid level thereof;

said boss having a threaded aperture communicating with the interior of said P trap for receiving a threaded connector; and conduit means including a threaded connector cooperating with said threaded aperture for interconnecting said first and second fittings for directing the waste water from the sink drain to the floor drain water trap for maintaining a constant water level in the floor drain water trap to insure a proper trap seal therein upon use of the sink.

* * * * *

REEXAMINATION CERTIFICATE (1288th)

United States Patent [19]

Taglarino

[11] B1 4,218,786

[45] Certificate Issued May 29, 1990

[54] WATER SAVING TRAP PRIMER

[76] Inventor: Joseph Taglarino, 107 S. Lincoln Ave., Tampa, Fla. 36609

Reexamination Request:
No. 90/001,180, Feb. 24, 1987

Reexamination Certificate for:

| | |
|---|---|
| Patent No.: | **4,218,786** |
| Issued: | **Aug. 26, 1980** |
| Appl. No.: | **10,373** |
| Filed: | **Feb. 8, 1979** |

[51] Int. Cl.[5] ..... E03C 1/24

[52] U.S. Cl. ..... 4/206; 4/DIG. 9; 4/207; 4/191; 4/415; 4/653; 4/661

[58] Field of Search ..... 4/191; 137/247.25, 216 D, 137/533.11, 433, 118

[56] References Cited

U.S. PATENT DOCUMENTS

| | | | |
|---|---|---|---|
| 680,380 | 8/1901 | Hyde | 137/247.25 |
| 1,661,532 | 3/1928 | Fortain . | |
| 2,317,653 | 4/1943 | Walker . | |

OTHER PUBLICATIONS

"Plumbing", Harold E. Babbitt, 1960, pp. 261, 309–310, 499–500.

"Sanitary Plumbing", R. M. Starbuck, 1951, pp. 58, 60.

*Primary Examiner*—Charles E. Phillips

[57] ABSTRACT

A primer is disclosed for installation in a floor drain water trap located in a lower position relative to a sink drain and sink water trap. A first fitting is disposed upstream of the floor drain water trap. A second fitting is disposed in the sink drain upstream of the sink water trap. A conduit interconnects the first and second fittings to direct waste water from the sink drain to the floor drain water trap thereby maintaining the water level therein to insure a proper seal in the floor drain water trap. The foregoing abstract is merely a resume of one general application, is not a complete discussion of all principles of operation or applications, and is not to be construed as a limitation on the scope of the claimed subject matter.

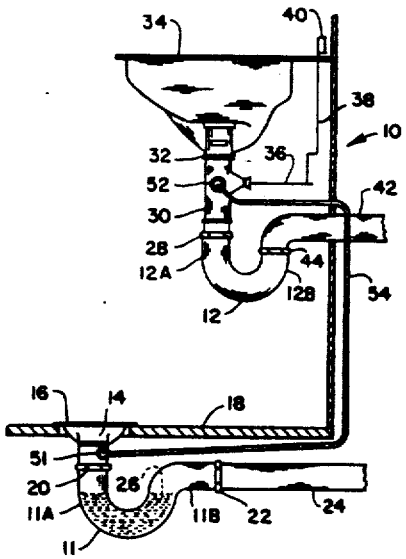

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4, 5, 7 and 8 are determined to be patentable as amended.

Claims 3 and 6 dependent on an amended claim, are determined to be patentable.

1. A primer for a [first] *floor drain* water trap, *the floor drain water trap having an inlet and an outlet adapted to be connected to sewer system with the floor drain water trap being* located below a *sink* drain *having an inlet adapted to be connected to a drainage port of a sink for* receiving waste water *and an outlet adapted to be connected to a sewer system*, comprising in combination:

a first fitting connected to the [first] *floor drain* water trap *above the normal water level therein;* a second fitting connected to the *sink* drain *intermediate said inlet and outlet of said sinkk drain*; and conduit means [interconnecting] *directly connecting* said first and second [fitting] *fittings* enabling the waste water received by the *sink* drain to be diverted by said conduit means to said [first] *floor drain* water trap for maintaining a constant water level in the [first] *floor drain water* trap to insure a proper seal therein upon use of the drain.

2. A primer [as set forth in claim 1, wherein ] *for a first drain water trap, the first drain water trap having an inlet and an outlet adapted to be connected to a sewer system and with the first water trap being located below a drain, the drain having an inlet adapted for receiving waste water and an outlet adapted to be connected to a sewer system, comprising in combination:*

*a first fitting connected to the first drain water trap;*

*a second fitting connected to the drain intermediate said inlet and outlet of said drain;*

*conduit means directly connecting said first and second fittings enabling the waste water received by the drain to be diverted by said conduit means to said first drain water trap for maintaining a constant water level in the first drain water trap to insure a proper seal therein upon use of the drain;* said first fitting [is] *being* disposed above the normal water level of the first *drain water* trap; and said second fitting [is] *being* disposed above the normal water level of a second trap enabling [the] waste water from the drain to enter said conduit means upon [the] elevation of the liquid level in the second trap.

4. A primer as set forth in claim 1, wherein said [second] *sink* fitting comprises an aperture in a side wall of a second trap for communicating with said conduit means.

5. A primer as set forth in claim 1, wherein said first fitting comprises an aperture in a side wall of the [first] *floor drain water* trap for communicating with said conduit means.

7. A primer for a floor drain water trap, *the floor drain water trap having an inlet and an outlet adapted to be connected to a sewer system* located in proximity to a sink *drain* water trap, *the sink drain water trap having an inlet adapted to be connected to a drainage port of a sink and an outlet adapted to be connected to a sewer system and with the sink drain water trap being* mounted in an elevated position relative to the floor drain water trap; *comprising* a first fitting disposed in the upstream end of the floor drain water trap;

a second fitting disposed in the upstream end of the sink water trap; and conduit means [interconnecting] *directly connecting* said first and second fittings for directing waste water from the sink to the floor drain water trap for maintaining a constant water level therein to insure a proper trap seal in the floor drain water trap upon use of the sink.

8. A primer for a floor drain water trap, *the floor drain water trap having an inlet and an outlet adapted to be connected to a sewer system* located below a sink drain [and] water trap, *the sink drain water trap having an inlet adapted to be connected to a drainage port of a sink and an outlet adapted to be connected to a sewer system,* comprising in combination:

a first fitting disposed in the floor [of said] drain water trap for providing liquid communication to the upstream side of the floor drain water trap;

a second fitting disposed in the sink drain for providing liquid communication to the upstream side of the sink water trap;

one of said fittings comprising a boss on the side wall of a P trap located above the normal liquid level thereof;

said boss having a threaded aperture communicating with the interior of said P trap for receiving a threaded connector; and conduit means including a threaded connector cooperating with said threaded aperture for [interconnecting] *directly connecting* said first and second fittings for directing the waste water from the sink drain to the floor drain water trap for maintaining a constant water level in the floor drain water trap to insure a proper trap seal therein upon use of the sink.

* * * * *